US009016734B2

(12) United States Patent
Barth et al.

(10) Patent No.: US 9,016,734 B2
(45) Date of Patent: Apr. 28, 2015

(54) CLOSING DEVICE COMPRISING A DETENT SPRING

(75) Inventors: Karsten Barth, Hattingen (DE); Thorsten Bendel, Oberhausen (DE); Serkan Gülkan, Hattingen (DE); Ulrich Weichsel, Duisburg (DE)

(73) Assignee: Kiekert AG, Heiligenhaus (DE)

( * ) Notice: Subject to any disclaimer, the term of this patent is extended or adjusted under 35 U.S.C. 154(b) by 341 days.

(21) Appl. No.: 12/997,591

(22) PCT Filed: May 26, 2009

(86) PCT No.: PCT/DE2009/000740

§ 371 (c)(1),
(2), (4) Date: Dec. 11, 2010

(87) PCT Pub. No.: WO2009/149686

PCT Pub. Date: Dec. 17, 2009

(65) Prior Publication Data

US 2011/0089705 A1 Apr. 21, 2011

(30) Foreign Application Priority Data

Jun. 13, 2008 (DE) ..... 10 2008 028 256
Aug. 22, 2008 (DE) ..... 10 2008 039 240

(51) Int. Cl.
*E05C 3/16* (2006.01)
*E05B 85/24* (2014.01)

(52) U.S. Cl.
CPC ..... *E05B 85/243* (2013.01); *Y10S 292/23* (2013.01)

(58) Field of Classification Search
USPC ..... 292/226, 216, 201, DIG. 23
See application file for complete search history.

(56) References Cited

U.S. PATENT DOCUMENTS

| | | | | |
|---|---|---|---|---|
| 3,520,159 | A * | 7/1970 | Swanney | 70/241 |
| 6,773,042 | B2 * | 8/2004 | Spurr et al. | 292/216 |
| 2003/0062727 | A1 * | 4/2003 | Reddmann | 292/197 |
| 2010/0052341 | A1 * | 3/2010 | Taurasi et al. | 292/304 |
| 2012/0181798 | A1 * | 7/2012 | Margheritti et al. | 292/200 |

FOREIGN PATENT DOCUMENTS

| | | | |
|---|---|---|---|
| DE | 195 47 727 | A1 | 6/1997 |
| EP | 1 818 484 | A1 | 8/2007 |
| GB | 1 340 706 | A | 12/1973 |
| GB | 2 303 129 | A | 1/1997 |

* cited by examiner

*Primary Examiner* — Mark Williams
(74) *Attorney, Agent, or Firm* — Renner, Otto, Boisselle & Sklar, LLP

(57) ABSTRACT

Locking device (1) comprising at least one locking mechanism (2) having a catch (3) and a pivotal first pawl (4), the operating lever (7) being movable so that during its movement the operating lever (7) interacts with a drive pin (20) of the first pawl (4) and a lateral pawl spring (35) acts between the drive pin (20) and the operating lever (7).

4 Claims, 3 Drawing Sheets

CLOSING DEVICE COMPRISING A DETENT SPRING

CROSS-REFERENCE TO RELATED APPLICATIONS

This is a National Stage Application of International Patent Application No. PCT/DE2009/000740, with an international filing date of May 26, 2009, which is based on German Patent Application No. 10 2008 028 256.1, filed Jun. 13, 2008 and on German Patent Application No. 10 2008 039 240.5, filed Aug. 22, 2008.

BACKGROUND OF THE INVENTION

1. Field of the Invention

The present invention relates to a locking device comprising at least one locking mechanism with a catch and a pivotable first pawl, wherein an operating lever is movable such that the operating lever cooperates during its movement with a drive pin of the first pawl. Thus, the invention relates in particular to a locking system with a preferably electrically-openable locking mechanism comprising a catch and at least two pawls, preferably for locking and unlocking movable doors, hatches, or back rests in motor vehicles.

2. Brief Description of the Related Art

In such a locking mechanism, it is common for the catch and/or the pivotable pawl with a spring to be so biased that they are always returned safely to their normal position. A spring element serves in the context, for example, to move the catch into its open position. It is also customary to provide for the catch-arresting pawl a pawl spring that moves the pawl toward a position in which the catch-arresting pawl cooperates with the catch in a movement-blocking manner. It is common to position the catch spring on the rotational axis of the pawl itself to achieve a stacked position of the pawl spring and the first pawl.

Known are locks for motor vehicle doors in which a first locking pawl (and often also a second pawl) is blocked or supported by a so-called blocking lever. At the same time, the blocking lever has usually the purpose of increasing the safety of the lock against accidental opening or intrusion. In other locking mechanisms with two pawls, the main focus is on providing a low-audible noise opening (avoiding of a so-called audible opening snap). Especially by activating the latch using (separate) operating levers, it is important that during the opening and/or closing movement, the catch is guided as precisely as possible. To this end, the pawl can be implemented with stops, which are brought into contact with the operating lever (and/or with the second pawl) to initiate the opening movement.

Such locking devices have usually very narrow installation space conditions. Especially for locking mechanisms designed with more than one pawl, there exists the need not to enlarge the installation space for the locking device to allow, where necessary, for retrofitting systems with one pawl. The functionality of the locking device is to be further improved.

BRIEF DESCRIPTION OF THE INVENTION

On this basis, it is the task of the present invention to solve the prior art problems, at least partially.

These tasks are achieved with a locking device having the features as in claim 1. Advantageous embodiments of the locking device are given in the dependent claims. It should be noted that in the claims, individually listed features can be combined in any technologically sensible way and to show further embodiments of the invention. The description, especially taken together with the figures, gives more details of the invention and the particularly preferred embodiments.

The inventive locking device comprises at least a locking mechanism with a catch and a pivotable first pawl, wherein an operating lever is movable in a way that during its movement the operating lever interacts with a drive pin of the first pawl and a lateral pawl spring acts between the drive pin and the operating lever.

The operating lever can be a separate component that is (directly) connected with an operating lever of the inner door handle and/or outer door handle. Similarly, the operating lever can also be a further pawl. It is particularly preferred to apply the invention to locking mechanisms with two pawls, as described, for example, in the (yet unpublished) application DE 10 2008 028 256. With regard to the design of such a locking device, the description of DE 10 2008 028 256 is incorporated herein by reference.

The drive pin is preferably shaped as a bolt disposed on a lateral surface of the first pawl, wherein possibly also several drive pins and/or other forms of a driver can be selected. A pawl spring is arranged laterally with respect to the first pawl, thus, in particular, not on a common axis of rotation with the first pawl. In other words, it is also preferred that the pawl and the pawl spring are arranged substantially in one plane. The pawl spring acts on the first pawl when the drive pin cooperates with the operating lever, whereby the action of the pawl spring is such that a safe coming together of the drive pin and operating lever is realized during the joint motion. Thus, it is possible to position other pawls and/or the operating lever on the rotational axis of the first pawl while not overly increasing the construction height along this axis.

In addition, it is considered advantageous that the operating lever and the pawl spring provide forced guidance for the first pawl. In other words, this means also that the operating lever exerts a force on the pawl in the direction of the open position and the pawl spring exerts a force on the first pawl in the direction of the closed position. This minimizes the range of motion of the first pawl so that a safe and controlled movement of the pawl is ensured, even taking into account vibrations and/or tolerances in the locking device.

In addition, it is preferred that the pawl spring is received in a seat of the first pawl. In other words, this means also that the pawl spring is hinged outside of the pivoting range of the first pawl and a portion of the pawl spring extends into the pivoting range, and this portion is received in the seat of the first pawl. The seat is preferably formed in the manner of a side recess at the bottom side of the first pawl. This seat is preferably so large that free play is possible. It is also preferred that the seat is several times wider than the pawl spring or the portion thereof that is disposed therein.

Precisely in this context, it is considered advantageous that the drive pin of the first pawl and the seat are formed opposite to one another. In other words, for example, the drive pin is formed on an upper side surface of one leg of the first pawl, and the seat is formed of the same leg side but on the lower side surface. The drive pin and the seat are preferably disposed on a portion of the first pawl, which is formed opposite to the locking surface of the first pawl.

The invention and the technical background are explained in more detail hereinbelow with reference to the figures. It should be noted that the figures show particularly preferred embodiments of the invention, but the invention is not limited to these embodiments.

DETAILED DESCRIPTION OF THE INVENTION

Figure 1:
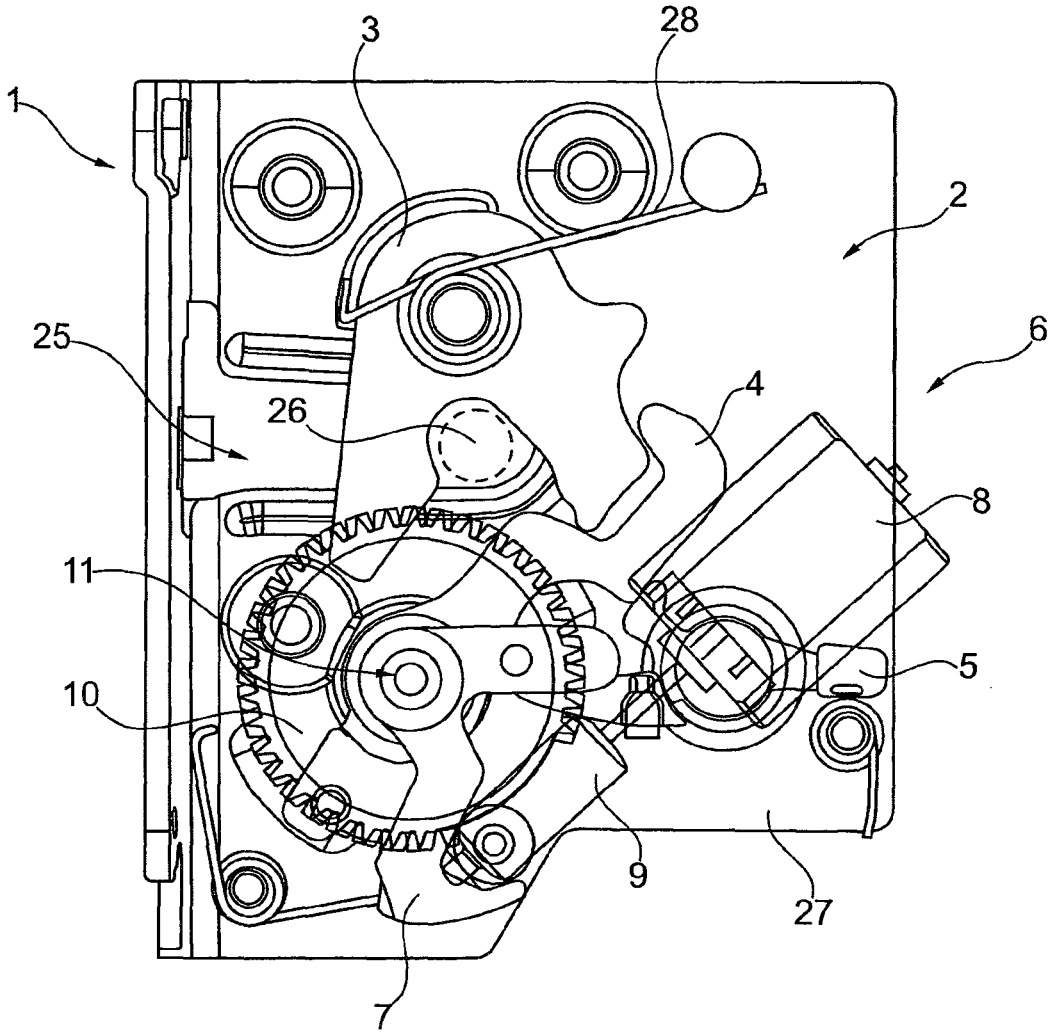
FIG. 1 shows a first embodiment of a locking device in a plan view in a closed position.

FIG. 1 shows a locking device 1, in which a locking mechanism 2 is implemented with a catch 3 and two pivoting pawls, namely the first pawl 4 and the second pawl 5. These three components are rotatably fixed on a base plate of the housing 27. Shown here is a plan view of a locking device 1, wherein the cover has been omitted. In the housing 27, an inlet 25 can be seen, which can receive the latch pin 26. In the locked position, the latch pin 26 is enclosed by the rotatable catch 3 so that the latch pin can no longer leave the inlet 25. The catch 3 is biased by the spring element 28 and, therefore, seeks to swing back (here clockwise) into the open position. In addition, it should be noted that seat cushions, seals, and the like are usually found between the locking device and the component to be locked so that the latch pin 26 also exerts a reset force on the catch 3.

FIG. 1 shows a locking device 1, in which a locking mechanism 2 is implemented with a rotary latch 3 and two pivoting pawls, namely, the first pawl 4 and the second pawl 5. These three components are rotatably fixed on a base plate of the housing 27. Shown here is a plan view of a locking device 1, wherein the cover has been omitted. In the housing 27, an inlet 25 can be seen on the left, which can receive the latch pin 26. In the locked position, the latch pin 26 is enclosed by the rotatable catch 3 so that the latch pin can no longer leave the inlet 25. The catch 3 is biased by the spring element 28 and, therefore, seeks to swing back (here clockwise) into the open position.

A pawl 4 is provided in order to prevent the catch 3 from pivoting back to the open position. The pawl 4 partially engages the catch 3 and blocks the catch with respect to its opening movement. The first pawl 4 is mounted on the bearing 11 on the housing 27. On the side of the first pawl 4, opposite the catch 3, is positioned a second pawl 5. The second pawl 5 is partially covered by the electric motor 8, which lies above it. The electric motor 8 is a part of the actuator 6. The interaction among the catch 3, the first pawl 4, and the second pawl 5 will be explained in detail below.

An operating lever 7 is provided at the bearing 11 above the first pawl 4. The function thereof is described in detail below. Also attached to this bearing 11 is a drive wheel 10 of the actuator 6, which is located above the operating lever 7. The electric motor 6 comprises an output shaft 9 in the form of a worm pinion, which cooperates with the toothing on the periphery of the drive wheel 10.

Figure 2:
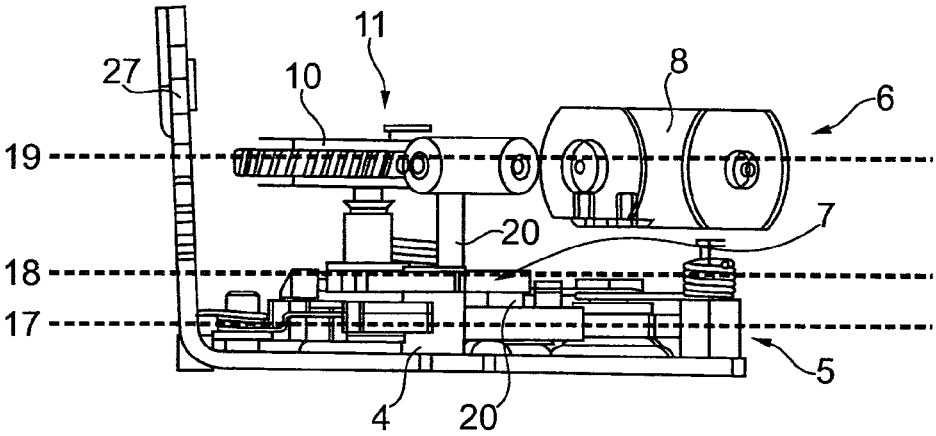
FIG. 2 shows the locking device of FIG. 1 in a side view.

FIG. 2 shows a side view of the locking device 1 shown in FIG. 1, wherein the figure shows three levels starting from the bottom of the housing 27. Near the housing 27 is first shown the first level 17, in which the locking mechanism 2 is arranged and comprises the two pawls 4 and 5, and the catch 3. In the second level 18, which lies above the first level is arranged the operating lever 7. Further up is the third level, marked 19, which accommodates members of the actuator 6. The left side of FIG. 2 shows that a single common bearing 11 is provided for the first pawl 4, the operating lever 7, and the drive wheel 10. The drive wheel 10 and the operating lever 7 are also (partially) movably-connected with one another by a drive pin 20, as is the case for the operating lever 7 and the second pawl 5.

Figure 3:
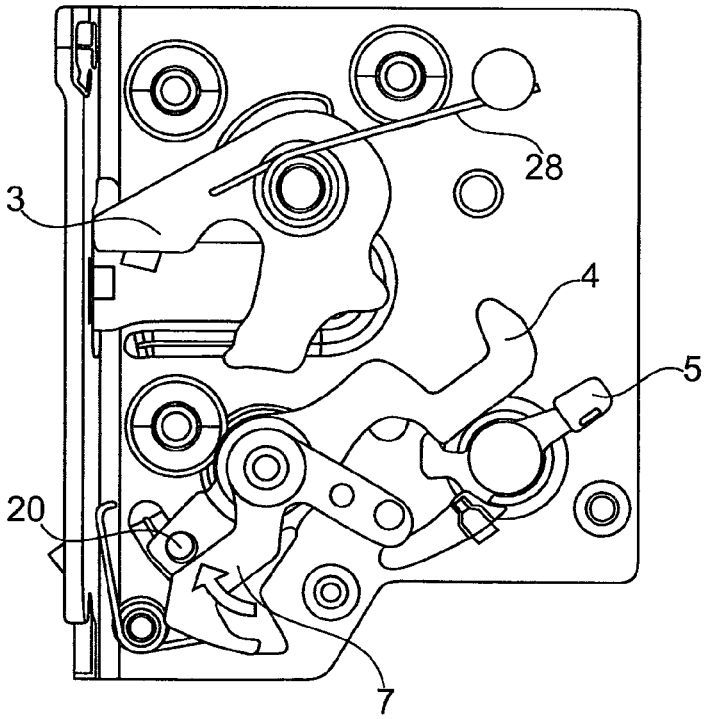
FIG. 3 shows a further locking device in an open position.

The lower part of FIG. 3 shows the position of the locking mechanism, in which the first pawl 4 is moved by the operating lever 7 into the desired position as the operating lever 7 is pivoted by the drive wheel 10 (not shown here). This occurs because the operating lever 7 is brought into contact with the drive pin 20 of the first pawl 4, and, in this way, the first pawl 4 is pivoted by the drive pin 20 due to the driven movement of the operating lever 7 (which is provided with a damping material). In the version shown here, the operating lever 7 steers both the first pawl 4 and the second pawl 5 toward the end of the opening movement, in which the movement of the first pawl 4 occurs later in time.

Figure 4:
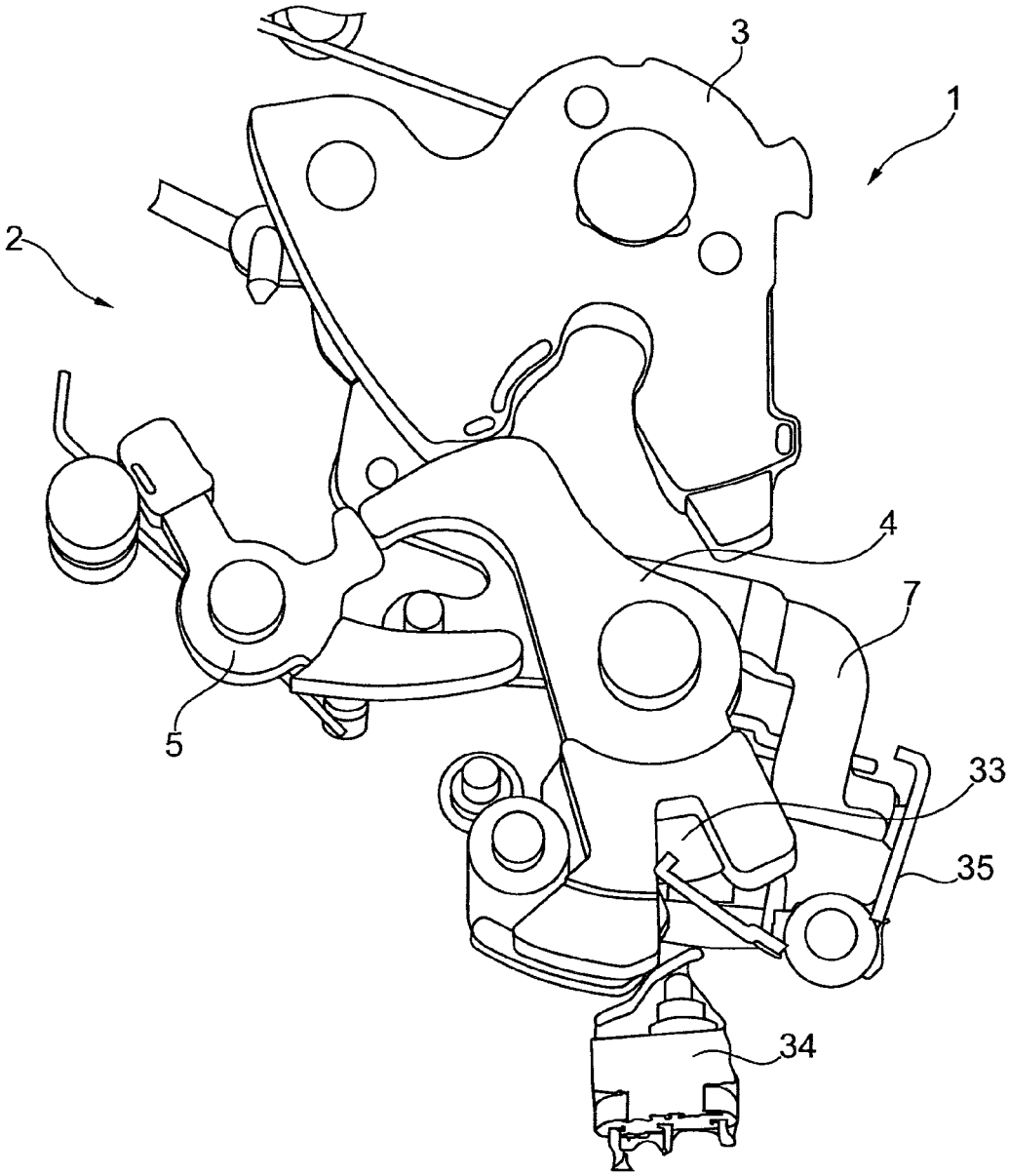
FIG. 4 shows a further embodiment of the locking device in a bottom view.

FIG. 4 shows an embodiment of a locking device 1, in which only a bottom view of the locking mechanism 2 is shown. The locking mechanism 2 is shown here in the closed position, such that the first pawl 7 is blocked by the second pawl 5. The operating lever 7 is mounted here on the same axis as the first pawl 4. In this rear view, it is easily seen that the first pawl 4 forms a seat 33, into which the laterally arranged pawl spring 35 encroaches. During the process, the pawl spring 35 engages and exerts a force on the first pawl 4 so that the first pawl 4 rests securely with its drive pin (not shown here) against the operating lever 7. This allows for the direct and immediate control of the first pawl 4, and, in particular, the play (tolerance) is balanced by means of the pawl spring 35. In addition, shown is here a micro switch 34 for detecting the position of the first pawl 4.

Although the invention has been described and explained herein in connection with the figures with respect to a specific design of the locking device comprising two pawls, it can equally be implemented favorably for different locking devices.

REFERENCE LIST

1. Locking device
2. Locking mechanism
3. Catch
4. First pawl
5. Second pawl
6. Actuator
7. Operating lever
8. Electric motor
9. Output shaft
10. Drive wheel
11. Bearing
12.
13.
14.
15.
16.
17. First level
18. Second level
19. Third level
20. Drive pin
21.
22.
23.
24.
25.
26. Latch pin
27. Housing
28. Spring element
29.
30.
31.
32.

33. Seat
34. Micro switch
35. Pawl spring

The invention claimed is:

1. A locking device comprising:

a locking mechanism with a catch, a first pawl that directly engages the catch in a locking position, and an operating lever mounted for pivotal movement about a common axis with the first pawl, wherein said operating lever, during pivotal movement about said common axis, directly engages a drive pin of said first pawl to drive the first pawl out of the direct engagement with the catch, and a lateral pawl spring acts between said first pawl and said operating lever by exerting a force on said first pawl to exert a biasing force holding said drive pin against said operating lever in the locking position, and the lateral pawl spring further acts to eliminate play between the first pawl and the operating lever as the operating lever drives the first pawl from the locking position to an open position.

2. The locking device of claim 1, wherein said operating lever and said pawl spring forcibly guide said first pawl.

3. The locking device of claim 1, wherein said pawl spring is received in a seat of said first pawl.

4. The locking device of claim 2, wherein said pawl spring is received in a seat of said first pawl.

* * * * *